United States Patent [19]

Negre et al.

[11] Patent Number: 4,734,050

[45] Date of Patent: Mar. 29, 1988

[54] UNIVERSAL CONNECTION UNIT

[75] Inventors: Jean-Jacques Negre, Nanterre; Jean Kertesz, Andresy, both of France

[73] Assignee: Societe Nouvelle de Connexion, France

[21] Appl. No.: 868,865

[22] Filed: May 30, 1986

[30] Foreign Application Priority Data

Jun. 7, 1985 [FR] France ..... 85 08656

[51] Int. Cl.[4] ..... H01R 13/28

[52] U.S. Cl. ..... 439/289; 439/578; 439/819; 439/824

[58] Field of Search ..... 339/177, 255 R, 256 R, 339/65, 48

[56] References Cited

U.S. PATENT DOCUMENTS

| | | | |
|---|---|---|---|
| 2,757,351 | 7/1956 | Klostermann | 339/177 R |
| 3,275,970 | 9/1966 | Johanson et al. | 339/177 R |
| 3,416,125 | 12/1968 | Theve | 339/177 R |
| 3,609,637 | 9/1971 | Cole | 339/177 R |
| 4,174,875 | 11/1979 | Wilson et al. | 339/177 E |
| 4,588,241 | 5/1986 | Ardygone | 339/177 R |

*Primary Examiner*—Gil Weidenfeld
*Assistant Examiner*—David Pirlot
*Attorney, Agent, or Firm*—Thomas S. MacDonald; Alan H. MacPherson; Paul J. Winters

[57] ABSTRACT

The invention relates to a connection unit of universal type. This comprises two complementary connection elements (1,2) with a coaxial structure having at least one peripheral part and a central conductive core. The peripheral part(s) of one of the connection elements (1) are in sleeve form. The sleeves (10) and the contact (11) are mounted movably in translation in the direction of the longitudinal axis Δ of the male element (1). The sleeves (10) and the contact (11) are mechanically independent. The connector of this invention has application to connectors for radio frequency and/or numerical or analog signals.

7 Claims, 5 Drawing Figures

UNIVERSAL CONNECTION UNIT

BACKGROUND OF THE INVENTION

Figure 1A:
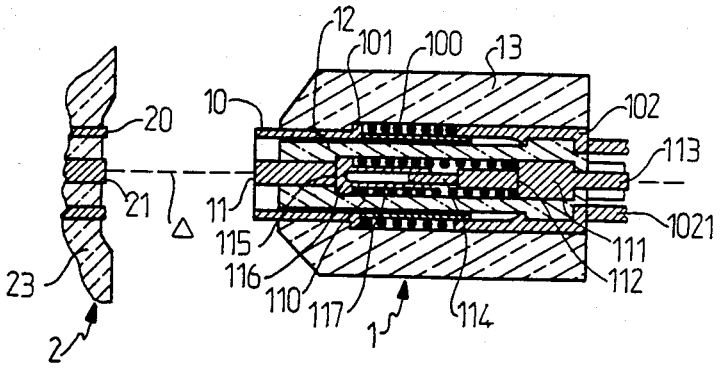

The present invention relates to a universal connection unit with a coaxial structure.

The connection units with coaxial structure presently used are constituted by two plugs, a male plug and a female plug, the connection-disconnection of these being effected by slidingly plugging in/out. In general, these connection units are used either for connection by means of coaxial cables, for the transmission of radio-electric signals, or for the connection of cables with two twisted conductors having peripheral screening for the transmission of numeric or analog signals. In all cases, the connection-disconnection is effected by slidingly plugging in/out the male plug into the female plug.

Such connection units, although they permit good electrical transmission characteristics of these signals, particularly with low attenuation of the signal transmitted over a wide band of frequencies, have nevertheless inconveniences which relate to the risk of wear of the parts in electrical contact due to numerous connections/disconnections. Further, the arrangement of the connectors having a plurality of plugs of this type, particularly in the case of chassis connectors able to be plugged in known as "rack" connectors, have the major inconvenience of needing significant extraction forces for the operation of numerous cycles of connection-disconnection.

THE INVENTION

The present invention has the object of remedying the mentioned inconveniences by providing a connection unit with a coaxial structure of universal type.

Another object of the present invention is to provide a connection unit able to permit the transmission of electric signals of any type either continuous, pseudo-continuous or slowly varying signals, or radio-electric signals of very high frequency, preferably microwave signals, with a very low attenuation in transmission.

Another object of the present invention is to provide a connection unit for which the connection/disconnection operation is effected with a very low extraction force for disengagement.

Another object of the present invention is the provision of a connection unit for which numerous cycles of connection/disconnection are effected practically without noticeable wear of the electric contact points, each operation of connection/disconnection being effected substantially without tangential friction force of the mentioned parts.

Another object of the present invention is in fact the provision of a connection unit for which the contact pressure of the parts in electric contact is substantially constant with time and the wear caused by a significant number of connection/disconnection cycles, although very low, is further reduced by removing the play between the parts in electrical contact.

The universal connection unit with a coaxial structure according to the invention comprises two complementary connection elements. Each connection element has at least one peripheral part forming a connection part and a central core constituted by a contact electrically insulated from the peripheral parts. According to the invention, the peripheral part(s) of the male connection element, is in sleeve form, the sleeves and the contact being mounted movably in translation in the direction of the longitudinal axis of the male element. The sleeves and the contact are mechanically independent.

The connection unit of the invention finds application in the radio-telephone field, the transmission or the reception of numeric data represented in the form of electrical signals, the informative material for which the connection unit of the invention can advantageously be used in the production of chassis connectors.

THE DRAWINGS

The invention will be better understood from reading the description and studying the accompanying drawings in which:

FIG. 1*a* shows, in cross-section on a longitudinal plane of symmetry, a connection unit according to the invention.

Figure 1B:
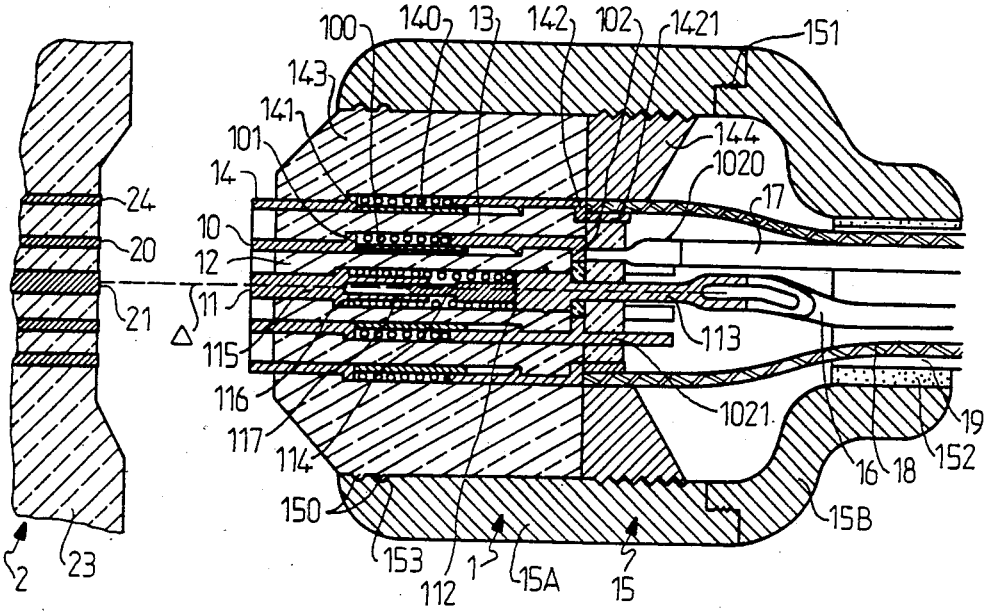

FIG. 1*b* shows, in cross-section on a longitudinal plane of symmetry, a particular embodiment of a connection unit according to the invention.

Figure 1C:
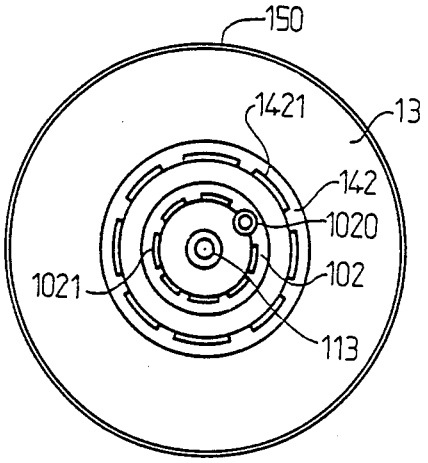

FIG. 1*c* shows a rear view of a detail of the embodiment of FIG. 1*b*.

Figure 2A:
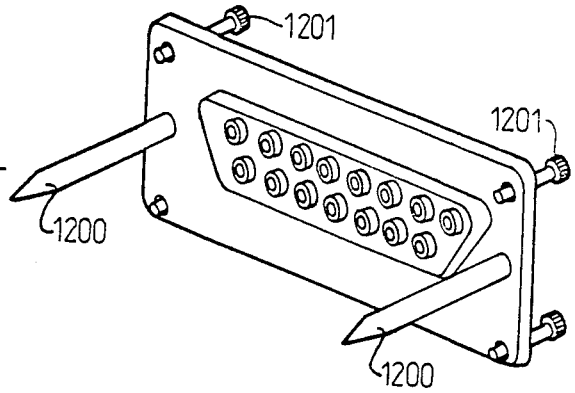
Figure 2B:
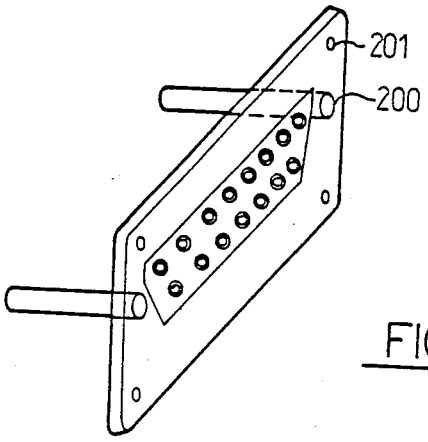

FIGS. 2*a* and 2*b* show a chassis connector providing a plurality of connection units according to the invention.

The universal connection unit with a coaxial structure according to the invention will now be described in connection with FIGS. 1*a*, 1*b*, and 1*c*.

FIRST EMBODIMENT

According to FIG. 1*a*, the connection unit comprises two complementary connection elements referenced respectively 1 and 2. Each connection element comprises at least one peripheral part referenced 10 for the connection element 1 and 20 for the connection element 2 forming the connection part and a central core referenced 11 and 21 respectively constituted by a contact electrically insulated from the corresponding peripheral parts. In FIG. 1*a* is shown a connection unit according to the invention more specially adapted to the connection of coaxial cables comprising a central conductor and a peripheral screen principally used for the transmission or reception of radio-electric signals.

According to the invention, and in the particular case of FIG. 1*a*, the peripheral part 10 of one of the connection elements, the element 1 in this case, as in the form of a sleeve, the contact 11 and the sleeve 10 being mounted movably in translation in the direction of the longitudinal axis $\Delta$ of the connection element 1. The sleeve 10 and the contact 11 are mechanically independent of each other. The connection element 1 is called the male element. In contrast to this designation, the connection element 2 is called the female element and is constituted by a contact 21 constituting the central core and by a sleeve 20 forming the peripheral part of the connection element 2 in the case of the nonlimiting embodiment of FIG. 1*a*. Of course, the contact 21 and the sleeve 20 of the female connection element have substantially identical electrical sections and dimensions, in a plane perpendicular to the longitudinal axis $\Delta$ of the connection unit, in comparison with those of the male element. Electric sections and dimensions refers to the diameter of the contact section forming the central core, and the internal diameter of the sleeves 10 and 20 of the male and female connection elements which define the propagation parameters of radio-electric signals of high frequency or hyper-frequency transmitted by the connection element.

The electric connection between the two connection elements, the male element 1 and the female element 2, is made by bringing into flush abutment of the peripheral parts or sleeves 10,20 and respective contacts 11,21 of the male 1 and female 2 connection elements respectively.

It will be understood that the male or female designation of the connection elements is a designation having the object of differentiating each constituent connection element of the connection unit of the invention, although the connection/disconnection of the mentioned unit is in fact carried out without reciprocal plugging in/out of the connection elements 1 and 2.

The connection elements 1 and 2 are connected together by bringing into flush abutment the corresponding parts of the connection elements 1 and 2, with a sufficient alignment as determined by the the manufacturing and assembly tolerances of the mentioned mechanical pieces, along the respective longitudinal axes of the male and female connection elements 1 and 2.

In order to ensure a substantially constant contact pressure between the corresponding peripheral parts and the contact forming the central core of the connection elements 1 and 2, the sleeve 10 and the contact 11 of the male connection element 1 are provided with elastic return means allowing mechanical and electrical contact with the peripheral part 20 and the contact 21 respectively of the female connection element 2. The elastic return means can be constituted by springs referenced 100, 110 and acting respectively on the sleeve and the contact 11.

SECOND EMBODIMENT

A variant or second embodiment of the universal connection unit of the invention, will now be described in connection with FIG. 1*b* in the case where each male 1, female 2, connection element comprises a plurality of peripheral parts in order to ensure, via the intermediary of these peripheral parts, either screening of the totality or a part of the correpsonding connection element, or transmission of a current or voltage signal given by the connection of the peripheral part corresponding to a predetermined conductor constituent of the cable to the connection unit.

In FIG. 1*b*, is shown a connection unit according to the invention in which each male 1, female 2, connection element comprises two peripheral parts each constituted by sleeves arranged concentrically to the contact 11 constituting the central core. In FIG. 1*b*, the sleeve situated in the immediate proximity of the contact 11 is referenced 10 in an analogous manner to FIG. 1*a*, whilst the sleeve the furthest outside with respect to the male connection element 1 is referenced 14, the corresponding sleeves of the female connection element 2 having in an analogous manner the references 20 and 24. Of course, the sleeve 14 of the male connection element 1 is provided with elastic return means in a manner analogous to the sleeve 10. These elastic means are also constituted by a spring referenced 140 and allow the mechanical and electrical contact of the sleeve 14 with the corresponding sleeve 24 of the female connection element 2 by bringing them into flush abutment.

Embodiment details relative to the connection units according to the invention so far as concerns the embodiment of FIG. 1*a* as well as FIG. 1*b* will be given by way of nonlimiting examples.

As shown in the mentioned Figures, the male connection element 1 comprises for example a cylindrical insulating body 12 mechanically fixed to the body of the male connection element 1. In this cylindrical insulating body is mounted slidingly on the longitudinal axis the contact 11 forming the central core. Further, a tubular conductor element constituting the sleeve 10 in the case of FIG. 1*a* is slidingly engaged on the insulating cylindrical body 12. The tubular conductor element has in a plane perpendicular to its lengthwise direction a rib or shoulder referenced 101. In the case of FIG. 1*b*, a second tubular element constitutes the sleeve 14 and is slidingly engaged on another insulating cylindrical body 13. The tubular conductor element constituting the sleeve 14 also has in a plane perpendicular to its lengthwise direction a rib or shoulder referenced 141. The springs 100 and 140 are respectively engaged on the sleeves 10 and 14 and act on these via the intermediary of corresponding ribs 101, 141 and of a fixed conducting part referenced 102, 142, constituted for each sleeve 10 and 14 and also by a tubular conductor element fixed in the male connection element 1. The springs 100 and 140 bear on the corresponding fixed parts 102 and 142, which further assure the mechanical cohesion of the cylindrical parts 12 and 13 respectively. Further, in the case of FIG. 1*b*, the cylindrical element or insulating cylindrical body 143 surrounds the sleeve 14 and the fixed part 142 the furthest outside in a manner to ensure the mechanical cohesion of the assembly. Of course, the insulating cylindrical bodies 12,13 and 143 in the case of FIG. 1*b* are adapted in a manner to define with the ribs 101,141 and the fixed parts 102,142 housings in which the springs 100 and 140 are mounted. Further, the parts of the sleeves 10 and 14 on which the springs 100, 140 are engaged are constituted by a slit sleeve having a plurality of elastic blades extending longitudinally of the axis $\Delta$ of the male connection element 1. Thus, on positioning and making contact by flush abutment of the male connection element 1 and of the female connection element 2, the movable contact parts constituted by the contact 11 forming the central core, the sleeve 10 and, in the case of FIG. 1*b*, the furthest outside sleeve 14 are pushed inside the body of the male connection element 1, the elastic force of the springs maintaining suitable contact pressure on the corresponding parts of the female contact element 2. It will be noted in particular that the electric contact between the sleeves 10 and 14 and their fixed corresponding parts 102, 142 is brought about with good electric continuity even at the highest frequency because of the presence of elastic blades forming the slit sleeve and of the compressed springs.

As concerns the contact 11 forming the central core, this can, as shown in FIGS. 1*a* and 1*b*, comprise a substantially cylindrical connection base having a shoulder 112. The connection base and the shoulder 112 are embedded in the insulating cylindrical body 12 in a manner to leave free on one end a connection zone 113 outside the insulating cylindrical body 12 intended to receive a conductor of the cable to be connected and on the opposite end inside the housing of the cylindrical body 12 a contact needle referenced 114. The contact 11 forming the central core further comprises a cylindrical element 115 comprising in a plane perpendicular to its lengthwise direction a shoulder referenced 116. The opposite part, with respect to the shoulder 116, to the part of the cylindrical element 115, forming an active part of the contact 11, is constituted by an element of the slit sleeve type 117. The spring 110 acting on the contact 11 is engaged on the slit sleeve 117 and on the contact needle 114, between the shoulders 116, 112 respectively of the cylindrical element 115 and of the connection base 111 on which the spring 110 abuts. The contact needle 114 is thus able to be engaged in the slit sleeve 117 on connection of the connection unit.

The connection element 2 shown in either FIG. 1*a* or FIG. 1*b*, can be constituted simply by a cylindrical element 21 constituting the contact forming the central core of the element of the female connection 2, and the peripheral parts 20 and/or 24 constituting tubular conductor elements of the sleeve type, the assembly of the contact 21 and the tubular conductors 20,24 being embedded in a block of insulating material 23 and being brought into flush abutment simply with the free face of insulating block 23.

In a nonlimiting manner, the peripheral parts and the central core respectively referenced 20,24 and 21 of the female conductor 2 can advantageously be produced by conductor elements of printed circuits in which the dimensions are configured to the respective dimensions of the conductive parts of the male connection element 1.

The assembly of the conductive parts of the elements of the male connection 1 and female 2, that is to say contact element 11 and connection base 111, sleeves 10, 14 and fixed parts 102,142, contact needle 114, and of the female connection element 2, contact 21 forming the central core, peripheral part 20,24 can be constituted in a nonlimiting manner in an alloy of copper having a covering of gold or silver. The insulating parts 12,13,143,23 can preferably be constituted in a dielectric material with a small loss angle such as for example polytetrafluorethylene. As concerns on the contrary the elastic elements, for example the springs 100,110 and 140, these can, preferably, be constituted in a material such as an alloy of copper and beryllium providing the springs with good properties of elasticity. Further, preferably, the housings constituted essentially by the cylindrical insulating elements, the shoulders or ribs 141,101,116 and the fixed parts 142, 102,112 can advantageously be formed in a manner to have a longitudinal dimension, that is to say a dimension in the direction parallel to the axis Δ, such that in a connection position, the assembly of mentioned springs is deformed by compression in a manner such that their spirals are closed. This particular arrangement has the effect of presenting, particularly at the level of the wall constituted by the closed spirals of the spring a quasi continuous wall presenting good conditions to limits of propagation of radio-frequency signals. It can be stated, in the course of experiments carried out, that, particularly in these conditions, the part of the sleeves 14 and 10 constituted by the slit sleeve, that is to say by the elastic blades, withstood usage without major degradation in transmission quality.

From frequency experiments relative to the transmission from a connection unit such as shown in FIG. 1*a*, the sleeve 10 and the corresponding fixed part 102 being connected by connection pins 1021 to the screen of a coaxial cable and the connection zone 113 being connected to the central core of the same cable, have shown an insertion loss less than one decibel over a frequency band in the ratio of 10 for a maximum neighbouring frequency greater than 1 GHz.

A detailed description of the rear part of the connection unit according to the invention as shown in FIG. 1*b* will now be given in connection with this figure. As appears in this figure, the fixed part 142 of the furthest outside sleeve of the male connection element 1 is provided with terminals or contact zones 1421. In the same manner, the fixed part 102 of the intermediary sleeve is provided with terminals or contact zones 1021 and the connection base 111 is itself provided with a connection zone 113. As appears in this Figure, it will be noted that the connection terminals 1421,1021 and 113 have, in this order, an ascending length parallel to the axis Δ of the male connection element 1. Further, one of the connection terminals 1021 can be provided with a base intended to receive directly a cable conductor to be connected in a manner permitting the connection of this by crimping or by deposit of metal. In the embodiment of FIG. 1*b*, this base is designated 1020. Similarly, the connection zone 113 is also provided at its outside with a base intended to receive a cable of a conductor to be connected, in a manner to be able to effect a connection of this cable onto the base by crimping or by deposit of metal. In FIG. 1*b*, the cable connected to the base 1020 is referenced 17 and the cable connected to the base of the terminal or connection zone 113 is referenced 16. Similarly, the peripheral screen of the cable or metallic braid is referenced 18. The mechanical and electrical connection of the metallic braid 18 is made by means of an auxiliary piece or nut 144, directly engaged by screwing the shell or protective body 15 or more particularly on a first part 15A of the protective body 15. The first part 15A of the protective body 15 is fixed to the insulating material block or insulating cylindrical element 143 by the intermediary of an assembly of grooves referenced 153 arranged inside the part 15A of the protective body and corresponding ribs 150 arranged specially for this in the region of the periphery of the insulation cylindrical element 143. After positioning the conductors 16,17,18 on their respective terminals or connection zones by crimping or deposit of metal as concerns the conductors 16 and 17, the screen or metallic braid being held in contact on the corresponding terminals 1421, the auxiliary piece 144 can be engaged in the corresponding thread of the part 15A of the protective body and tightened in a manner to ensure the mechanical cohesion of the metallic braid 18 with the contact zones 1421 and their electrical contact. Then, the complementary part 15B of the protective body can be engaged on the corresponding threading 151 in a manner to close the protective body 15. The fluid-tightness of the protective body, in the region of the connected cable, can further be effected by means of a point or pressure stuffing 152 which comes into direct contact with the insulation or sheath of the connector cable 19.

It will be noted in particular due to the structure of the rear part of the connection unit, shown in FIG. 1*b*, that this can be used in an advantageous manner either for the connection of a cable to be connected having two twisted conductors 16,17 and a peripheral screen 18, or simply a coaxial cable having a central core and a peripheral screen. In this latter case, the central core is directly connected to the connection base of the connection zone 113 and the peripheral screen such that the braid 18 can then be connected onto the terminals or connection zones 1021 connected to the fixed part 102 of the sleeve 10, the base 1020 being for example sectioned for its suppression. The mechanical cohesion an the electric contact between the braid 18 and the terminals or contact zones 1021 can be effected by an auxiliary conductive piece 144, similar to the auxiliary conductive piece previously described, of which the dimenisons have been adapted to the corresponding dimensions of the fixed part 102 and of the connection or contact zones 1021. Further, the electric contact can be ensured by simple mechanical and electrical contact between the adapted auxiliary piece 144 and the contact zones or terminals 1421 fixed to the fixed part 142 of the outermost sleeve 14.

Further, the connection unit shown in FIG. 1*b* advantageously permits, due to its structure, the connection of coaxial cables having a central core and two concentric screens.

FIG. 1*c* shows a rear view of a connection unit of FIG. 1*b*, in which the part of the protective body 15B and 15A as well as the auxiliary piece 144 are removed in the absence of conductors of the cable to be connected. In this figure, the relative arrangement of the connection zones or terminals 1021, 1421, 113 and the connection bases 1020 are shown. It can be stated in particular that the assembly of the male connection unit 1 is substantially symmetrical in revolution about the axis Δ. It will be understood in particular that in the embodiment of FIG. 1*b*, the electric dimensions of the contact 11 of the sleeve 10 of the insulating cylindrical element 12, of the contact 21 of the peripheral part 20 can advantageously be chosen identical to those of a connection unit as shown in FIG. 1*a*. In these conditions, the conditions of propagation of radio-electric signals, when the connection unit as shown in FIG. 1*b* is used for connecting of a coaxial cable, remain substantially analogous to those obtained in the conditions of use of the connection unit such as shown in FIG. 1*a*. It will be understood in consequence that the connection unit, the object of the invention, shown in FIG. 1*b*, can advantageously be utilized either for the connection and joining of cables with two twisted conductors having a peripheral screen, or for the connection and joining of coaxial cables justifying in this the universal character of the connection unit of the invention.

The connection unit according to the invention, such as defined previously, can be advantageously used for production of connectors having at least one male connection element 1 constituting the male part of the connector. The female part of the connector comprises at least one female connection element 2.

As shown in FIGS. 2*a* and 2*b*, in the case of a connector for a chassis, the male and female connection elements are arranged in a block of insulating mterial constituting the male and female parts of the connector body. The male and female parts of the connector body are provided with means for centering and fixing. The male part of the body of the connector as shown in FIG. 2*a* can comprise in a nonlimiting manner guiding columns 1200 and fixing bolts 1201. Similarly, the female part of the connector body shown in FIG. 2*b*, can comprise grooves or slide guides 200, in which, for making the connection, the guide columns 1200 of the male connector part are engaged. Further, screw threads 201 are provided opposite the fixing bolts 1201 of the corresponding male part. The columns 1200 having been engaged in the slides 200 in order to effect the connection and the necessary contact pressure being established, the screwing into position of the connection is then carried out by screwing of the bolts 1201 into the corresponding threads 201. The centering obtained in the region of each of the connection units of the invention constituting the connector is quite sufficient for ensuring the connection at the level of each connection unit, taking account of manufacturing tolerances and normal machining of the connecting material, whatever the use of the connection units for the transmission of radio electric signals or numeric or analog signals, as previously described. It can simply be added that experiments carried out, as regards the stability with time of the contact force or the conductance in the region of each of the contacts, of a connection unit of the invention have shown an excellent constance of stability after repetition of a connection/disconnection cycle greater than several thousand.

We claim:

1. A universal connection unit with a coaxial structure comprising:

two complementary connection elements called a male element and a female element;

each said connection element comprising:

at least one peripheral sleeve having a planar outer end surface, said sleeve forming a connection mass and a central core including a contact having a planar outer end surface, said core electrically isolated from said at least one peripheral sleeve;

said at least one sleeve and said contact of said male element being mounted moveably in translation in the direction of the longitudinal axis of said male element;

said at least one sleeve and said contact of said male element being mechanically independent; and said contact planar outer end surface and the planar outer end surface of said at least one sleeve of said female element having substantially identical electric sections and dimensions in a plane perpendicular to the longitudinal axis of said connection unit as those of said male elements;

wherein electric connection between said two connection elements is ensured by bringing into flush abutment the planar outer end surfaces of said respective peripheral sleeves and contacts.

2. A connection unit according to claim 1, wherein its conductive parts are constituted in a coated copper alloy, and its insulating parts being constituted in polytetrafluorethylene.

3. A connector according to claim 1, wherein said male and female connection elements are arranged in a block of insulating material constituting said male and female parts respectively of the connector body, said male and female parts being provided with centering and fixing means.

4. A connection unit according to claim 1 wherein upon connection and electrical transmission said unit has a loss through transmission less than one decibel over a frequency band in the ratio of 10 for a maximum neighboring frequency greater than 1 GHz.

5. A connection unit according to claim 1 wherein said at least one sleeve and said contact of said male connection element are provided with spring means for elastic return permitting their maintenance in mechanical and electrical contact with said at least one sleeve and said contact of said female element respectively.

6. A connection unit according to claim 5, wherein said male connection element comprises at least:

an insulating cylindrical body mechanically fixed to a body of said male element in which is mounted slidingly in the region of the longitudinal axis thereof said contact forming said central core, and a tubular conducting element, constituting one of said at least one sleeve, engaged slidingly on said cylindrical insulating body, said tubular conducting element having in a plane perpendicular to its lengthwise direction a rib, said spring means being engaged on said sleeve and acting on said sleeve by the intermediary of said rib and of a fixed part of said male connection element on which said spring means takes abutment, the parts of said sleeve on which said spring is engaged being constituted by a slit sleeve having a plurality of elastic blades.

7. A universal connection unit with a coaxial structure comprising:

two complementary connection elements called a male element and a female element;

each said connection element comprising:

at least one peripheral sleeve forming a connection mass and a central core constituted by a contact electrically isolated from said at least one peripheral sleeve;

said at least one sleeve and said contact of said male element being mounted moveably in translation in the direction of the longitudinal axis of said male element;

said at least one sleeve and said contact of said male element being mechanically independent;

said contact and said at least one sleeve of said female element having substantially identical electric sections and dimensions in a plane perpendicular to the longitudinal axis of said connection unit as those of said male element;

wherein electric connection between said two connection elements is ensured by bringing into flush abutment said respective peripheral sleeves and contacts;

wherein said at least one sleeve and said contact of said male connection element are provided with means for elastic return permitting their maintenance in mechanical and electrical contact with said at least one sleeve and said contact of said female element respectively;

wherein said male connection element comprises at least:

an insulating cylindrical body mechanically fixed to a body of said male element in which is mounted slidingly in the region of the longitudinal axis thereof said contact forming said central core; and a tubular conducting element, constituting one of said at least one sleeve, engaged slidingly on said cylindrical insulating body, said tubular conducting element having in a plane perpendicular to its lengthwise direction a rib, said elastic return means being engaged on said sleeve and acting on said sleeve by the intermediary of said rib and of a fixed part of said male connection element on which said spring takes abutment, the parts of said sleeve on which said elastic return means is engaged being constituted by a slit sleeve having a plurality of elastic blades; and wherein said contact forming said central core comprises:

a substantially cylindrical connection base having a shoulder, said shoulder of said connection base being embedded in said insulating cylindrical body in a manner to leave free a connection zone outside said insulating body intended to receive a conductor of a cable to be connected, and a contact needle inside of a housing of said insulating cylindrical body, a contact element constituting at one end a solid cylindrical contact member and at the other end extending lengthwise form a shoulder in a plane perpendicular to the lengthwise direction of said cylindrical contact member an element of slit sleeve type, said elastic return means acting on said contact being engaged on said slit sleeve and on said contact needle between said shoulders of said cylindrical element and of said connection base respectively on which said elastic return means abuts, said contact needle being able to be engaged in said slit sleeve on connection of said connection unit.

* * * * *